United States Patent [19]

Hatada et al.

[11] Patent Number: 4,791,984

[45] Date of Patent: Dec. 20, 1988

[54] HEAT TRANSFER FIN

[75] Inventors: Toshio Hatada, Tsuchiura; Tomihisa Oouchi; Yoshifumi Kunugi, both of Ibaraki; Shigeo Sugimoto, Ushiku; Junichi Kaneko, Ibaraki, all of Japan

[73] Assignee: Hitachi, Ltd., Tokyo, Japan

[21] Appl. No.: 42,253

[22] Filed: Apr. 24, 1987

[30] Foreign Application Priority Data

Apr. 25, 1986 [JP] Japan ..... 61-94515

[51] Int. Cl.[4] ..... F28D 1/04

[52] U.S. Cl. ..... 165/151; 165/181

[58] Field of Search ..... 165/151, 152, 153, 181

[56] References Cited

U.S. PATENT DOCUMENTS 4,300,629 11/1987 Hatada ..... 165/151

4,705,105 10/1987 Cur ..... 165/151

FOREIGN PATENT DOCUMENTS 3131737 4/1987 Fed. Rep. of Germany ..... 165/151

0069396 4/1983 Japan ..... 165/152

*Primary Examiner*—Ira S. Lazarus

*Assistant Examiner*—Sue Hagarman

*Attorney, Agent, or Firm*—Antonelli, Terry & Wands

[57] ABSTRACT

The present invention relates to a louvered heat transfer fin in which the air-passing resistance of the louver is varied so as to increase the overall heat exchange quantity, and thereby to greatly enhance the heat transfer performance of the fin. The arrangement of each louver is such that the projection area in the vicinity of the longitudinal central portion of the louver projected in the direction in which air passes is larger than the projection area of each of the longitudinal end sides of the louver projected in the same direction.

2 Claims, 5 Drawing Sheets

HEAT TRANSFER FIN

BACKGROUND OF THE INVENTION

The present invention relates to a heat transfer fin which may be used in an air(fluid)-cooled heat exchanger or the like, and more particularly to a louvered heat transfer fin capable of achieving a reduction in the air-passing resistance and excellent heat transfer characteristics.

Concerning heat transfer fins, louver fins with various configurations have conventionally been proposed, including, for instance, those disclosed in U.S. Pat. No. 4,300,629. However, the louvers of a conventional fin is constructed such that the projection area of any louver projected in the direction in which the air passes is kept constant, except for both end sides of the louver at which the louver is raised from the surface thereof.

With conventional fins having this sort of construction, since the resistance to the passage of air is kept constant in the longitudinal direction of the louver, the speed at which the air passes is also kept substantially constant in this direction. Conventional fins, therefore, have not been able to exhibit very high heat transfer characteristics.

SUMMARY OF THE INVENTION

An object of the present invention is to provide a heat transfer fin which is capable of achieving a great deal of improvement in the heat transfer performance.

Another object of the present invention is to provide a heat transfer fin which is constructed such that the louver provides a varied air-passing resistance so as to increase the overall heat exchanging capacity.

A further object of the present invention is to provide a heat transfer fin which is capable of ensuring an increase in the rigidity of the louver.

In order to achieve the above objects, the present invention provides a heat transfer fin which comprises, a base plate for the fin and mounted on heat exchanger tubes through fin collars and louvers formed on the base plate. Each of the louvers is cut and raised from a surface of the base plate and extends in a direction that crosses a direction in which a fluid flows. The louver has longitudinal end sides and a longitudinal central portion therebetween. A projection area of the louver in the vicinity of the longitudinal central portion thereof projected in the direction of the flow of the fluid is larger than a projection area of the louver in the vicinity of each of the longitudinal end sides thereof projected in the direction of the flow of the fluid.

A specific form of the present invention provides a heat transfer fin which comprises a base plate for the fin mounted on a plurality of heat exchanger tubes through fin collars and louvers formed on the base plate which is located between the heat exchanger tubes spaced in a direction that crosses a direction in which a fluid flows. The louver is cut and raised from a surface of the base plate and extends in the direction that crosses the direction in which the fluid flows. Each of the louver has a portion which is in the vicinity of the respective ones of the heat exchanger tubes and a longitudinal central portion. A section of the each louver sectioned in the direction of the flow of the fluid has a configuration which is angled with respect to a virtual line passing through the vertex of the angle and parallel to the direction of the fluid. An angle at which a section in the vicinity of the longitudinal central portion is angled is larger than an angle at which a section of said portion of the louver in the vicinity of the respective ones of the heat exchanger tubes is angled.

That is, the arrangement of the heat transfer fin in accordance with the present invention is such that, in the region of the air flow in which the difference in temperature between the air flow and the fin is large, the louver provides a low air-passing resistance, thereby increasing the air speed in this region, while in the region of the air flow in which the difference in temperature between the air flow and the fin is small, the louver provides a high air-passing resistance, thereby decreasing the air speed in this region.

By virtue of this arrangement, since the air-passing resistance is low in the region where the temperature difference between the air flow and the fin is large, the air speed is relatively high in this region, thereby greatly enhancing the heat transfer performance. On the other hand, although the air-speed drops in the region where the temperature difference is small because the air-passing resistance is high in this region, such a drop in the air-speed does not have much influence on the level of heat transfer performance. As a result, the overall heat transfer performance can be enhanced.

DESCRIPTION OF THE PREFERRED EMBODIMENTS

A heat transfer fin has louvers. The section through each louver in the direction in which the air passes has a shape that is angled with respect to a virtual line passing through the vertex of the angle and parallel to the direction in which the air passes. The section through the louver in the vicinity of the longitudinal center thereof is angled at an angle which is larger than the angle at which each of the longitudinal end sides of the louver is angled.

By virtue of this arrangement, the following effects are obtained. In this vicinity of the longitudinal central part of the louver where the section through each louver is angled at a large angle, the resistance to the air passing this part is increased, thus causing a drop in the air speed. On the other hand, at each of the two end parts of the louver in which the section through each louver is angled at a small angle, the resistance to the air passing these parts is decreased, thus causing an increase in the air speed. Since the temperature difference between the air flow and the fin is small in the longitudinal central part of the louver, a drop in the air speed in this part has little influence on the level of heat transfer performance. On the other hand, since the temperature difference between the air flow and the fin is large in the longitudinal end parts of the louver, an increase in the air speed in these parts allows a great deal of improvement in the level of heat transfer performance. As a result, efficient overall heat transfer performance of the fin is achieved.

Figure 1:
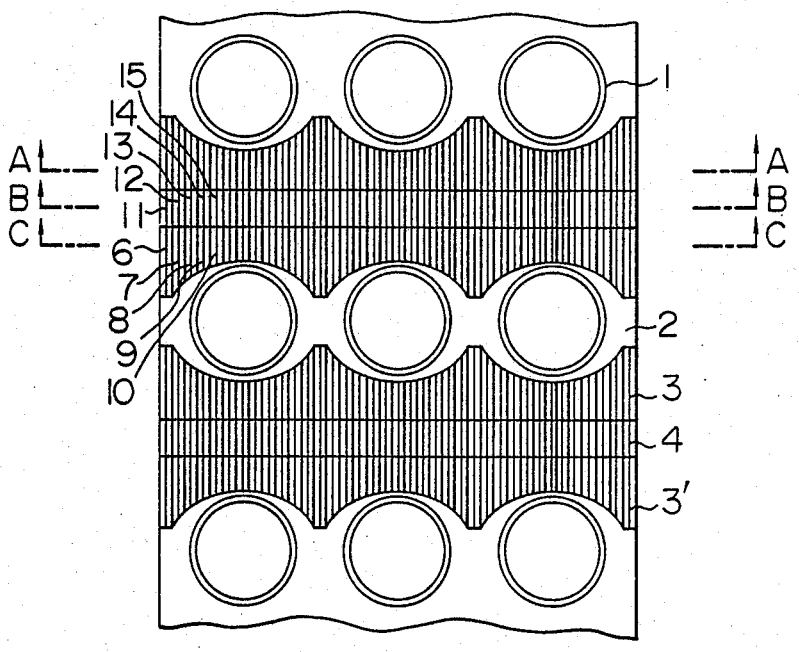
FIG. 1 is a plan view of a heat transfer in accordance with a first embodiment of the present invention.
Figure 2:
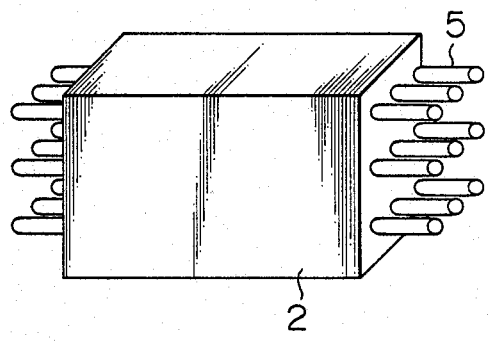
FIG. 2 is a perspective view schematically showing a fin-tube type heat exchanger.

An embodiment of the present invention will now be described with reference to the drawings. FIG. 1 is a plan view of a heat transfer fin in accordance with the present invention. FIG. 2 is a schematic view of an air-cooled heat exchanger to which the heat transfer fin of the present invention is applied.

Figure 3:
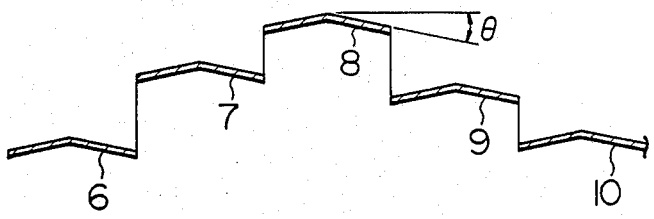
FIG. 3 is a fragmentary sectional view taken in the direction of the line A—A or line C—C shown in FIG. 1.
Figure 4:
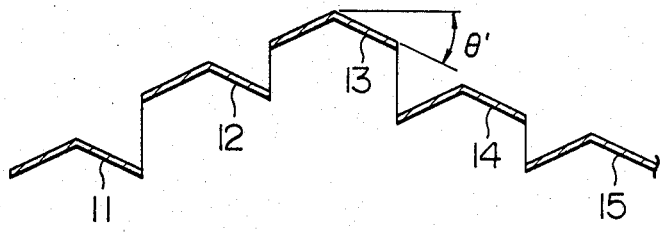
FIG. 4 is a fragmentary sectional view taken in the direction of the line B—B shown in FIG. 1.

Referring to FIGS. 1 and 2, reference number 1 designates fin collars which are brought into contact with heat exchanger tubes 5. A base plate 2 for the fin has one or more louvers. In the illustrated example, the fin has two louvers between three rows of heat exchanger tubes 5. Since each of these louvers has the same structure, its explanation is given of one of the louvers only. Each louver has two longitudinal end sides 3 and 3' and a central portion 4 therebetween. FIG. 3 is a sectional view through a part of the louver corresponding to the longitudinal end sides 3 or 3' of the louvers taken in the direction of the line A—A or C—C shown in FIG. 1. As shown in FIG. 3, the longitudinal end sides 3 and 3' of louvers comprise louver portions 6 to 10 each of which is angled at a small angle $\theta$. FIG. 4 is a sectional view through a part of the louver corresponding to the longitudinal central portions 4 of the louvers taken in the direction of the line B—B shown in FIG. 1. As shown in FIG. 4, the longitudinal central portions 4 of louvers comprise louver portions 11 to 15 each of which is angled at a large angle $\theta'$. In this way, the heat transfer fin in accordance with the present invention is provided with the louvers each having sections taken in planes parallel to the direction in which the air passes. The sections are angled and have different configurations in the longitudinal central portion 4 of the louver and the longitudinal end sides 3 of the same.

Next, the operation of the fin in accordance with this embodiment will be described.

Figure 5:
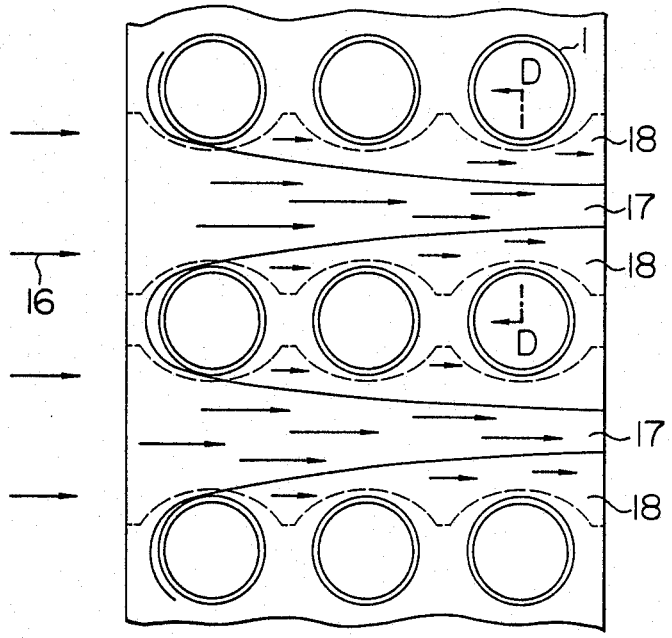
FIG. 5 is a schematic view showing an air-flowing pattern obtained by a conventional heat transfer fin.
Figure 6:
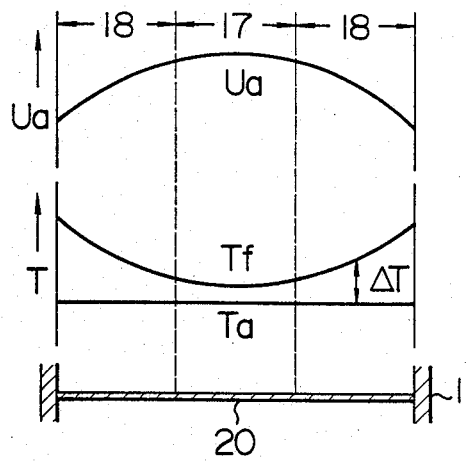
FIG. 6 is a diagram showing characteristics of the heat transfer fin shown in FIG. 5.

Explanation is first given of the characteristics of a conventional heat transfer fin of the conventional kind. With a conventional heat transfer fin in which the section through a louver in the direction in which the air passes is the same throughout the length of the louver regardless of the configuration of the louver, the air flows in a flowing pattern such as that shown in FIG. 5 because of the influence imparted by the presence of the heat exchanger tubes. That is, when the air flow 16 passes the fin, the presence of the fin collars causes a back wash which will affect the flow of downstream air, thus causing regions of two types in the air flow, i.e., a main stream region 17 in which the air flows at a high speed and a region 18 affected by the back wash in which the air flows at a low speed. Consequently, the air flow speed Ua at a point represented by a cross-section through the air flow, for instance at a cross-section taken along the line D—D shown in FIG. 5, will be high at the region 17 and low at the region 18, as shown in FIG. 6. On the other hand, the temperature of the fin Tf and the airflow temperature Ta tend to be such as shown in FIG. 6. That is, these temperatures have a relationship wherein the temperature difference $\Delta T$ ($\Delta T = Tf - Ta$) will be small in the region 17 and large in the region 18. Since the quantity Q of heat exchanged between the fin and the air is expressed by the formula $Q \propto U^n a \times \Delta T$, it is effective to increase the temperature difference $\Delta T$ and also to increase the air flow speed Ua in order to increase the product Q. With the conventional fin, however, since the arrangement is such that, in the region where the temperature difference $\Delta T$ is large, the air flow speed Ua is low, while in the region where the temperature difference $\Delta T$ is small, the air flow speed Ua is high, the resulting heat exchange quantity Q is small, thus exhibiting a low standard of performance.

Figure 7:
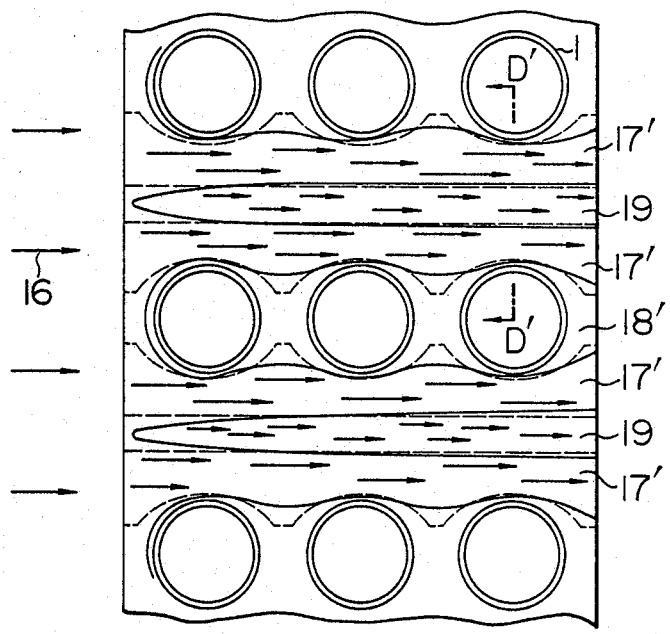
FIG. 7 is a schematic view showing an air-flowing pattern obtained by the heat transfer fin in accordance with the present invention.
Figure 8:
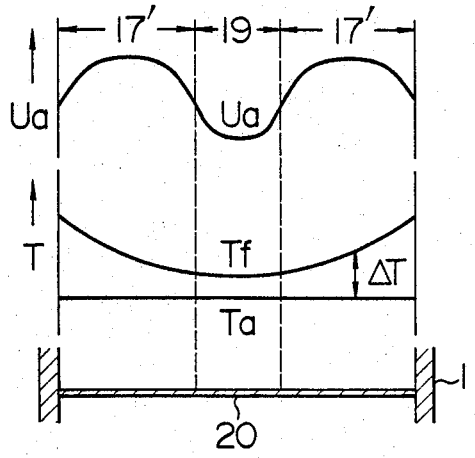
FIG. 8 is a diagram showing characteristics of the heat transfer fin in accordance with the present invention.

Next, the characteristics of the fin in accordance with the described and illustrated embodiment of the present invention will be described with reference to FIGS. 7 and 8. With the fin of the present invention, the longitudinal central part of the louver formed by the longitudinal central portion thereof provides a high air-passing resistance, while the longitudinal end parts of the louver formed by the longitudinal end sides thereof provide a low air-passing resistance. By virtue of this arrangement, the air passing across the fin flows in a pattern such as shown in FIG. 7. That is, a region 19 in which the air flows at a low speed is formed at the longitudinal central part of the louver, while regions 17' in which the air flows at a high speed is formed at the longitudinal end parts of the louver. FIG. 8 shows a cross-section taken along the line D'—D' shown in FIG. 7 and also a diagram corresponding to FIG. 6. As shown in FIG. 8, the air flow speed Ua is low in the region 19 while it is high in the regions 17'. On the other hand, the relationship between the fin temperature Tf and the air flow temperature Ta remains substantially unchanged. As a result, the air flow speed Ua can be made large in the regions where the temperature difference $\Delta T$ is large, thus remarkably increasing the heat exchange quantity $Q \propto U^n a \times \Delta T$. Although both values $\Delta T$ and Ua are small in the central region 19, the heat exchange quantity Q is inherently small in this region and, thus, the influence on the overall level of heat transfer performance is small.

Figure 14:
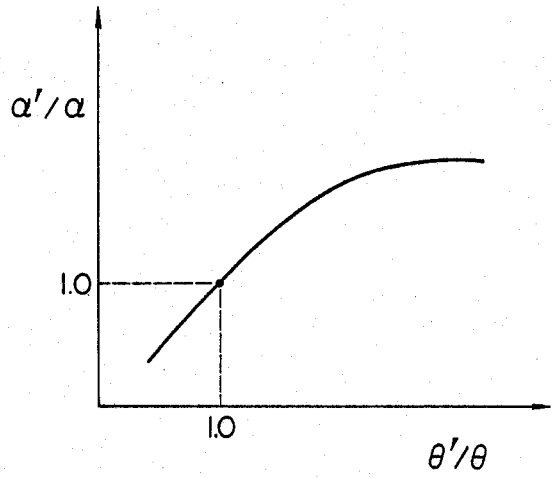
FIG. 14 is a diagram showing the change of the heat transfer rate with respect to the ratio between the angle at which the longitudinal central portion of a louver is angled and the angle at which each of the longitudinal end sides of the louver is angled.

It will be clearly seen from the diagram shown in FIG. 14 that a significant improvement in the heat transfer rate is provided by the present invention in which the ratio $\theta'/\theta$ between the angle $\theta'$ (shown in FIG. 4) at which the section through each louver in the vicinity of the longitudinal central portion is angled and the angle $\theta$ (shown in FIG. 3) at which the section through the louver in the vicinity of the longitudinal end sides, that is, in the vicinity of the heat exchanger tubes, is angled is made larger than 1, in contrast with the prior art in which the corresponding ratio $\theta'/\theta$ is equal to 1. In the diagram shown in FIG. 14, the axis of abscissa represents the ratio $\theta'/\theta$ between the angles at which the section of the longitudinal central portion of each louver and the section of each of the longitudinal end sides of the louver are respectively angled, while the axis of ordinate represents the ratio $\alpha'/\alpha$ of the heat transfer rate $\alpha'$ of a heat transfer fin in which the ratio $\theta'/\theta$ is other than 1 to the heat transfer rate $\alpha$ of the conventional heat transfer fin in which the ratio $\theta'/\theta$ is equal to 1. By virtue of the ratio $\theta'/\theta$ being made larger than 1 ($\theta'/\theta > 1$), the air flow rate flowing in the vicinity of the heat exchanger tubes can be increased, thus improving the heat transfer rate of the fin.

As described above, the heat transfer fin in accordance with the embodiment is capable of remarkably increasing the amount of heat exchange effected. In addition, since the longitudinal central portions of the louvers are respectively angled at a large angle O', the rigidity of the louver elements can be enhanced, enabling productivity to be increased and the fin to be made thinner.

Figure 9:
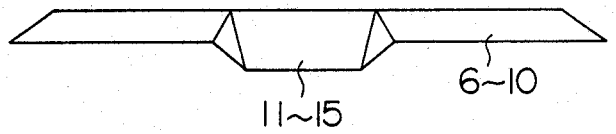
FIG. 9 is a projection view of a louver of the fin shown in FIG. 1 projected in the direction in which the air passes.

FIG. 9 shows a projection view of a louver of the louvered fin in accordance with the above-described embodiment. Each of the louvers is structured such that the projection area of the longitudinal central louver portion 11, 12, 13, 14 or 15 projected in the direction in which the air passes across the fin is larger than each of the projection areas of the longitudinal end portions 6, 7, 8, 9, and 10 projected in the same direction.

Figure 10:
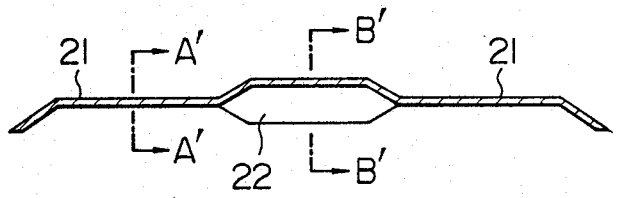
FIG. 10 is a view corresponding to FIG. 9 and showing a second embodiment of the present invention.
Figure 11:
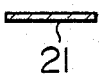
FIG. 11 is a sectional view taken along the line A'—A' shown in FIG. 10.
Figure 12:
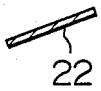
FIG. 12 is a sectional view taken along the line B'—B' shown in FIG. 10.

FIG. 10 shows a second embodiment of the present invention. In this embodiment, the section through each louver along a plane normal to the direction in which the air passes is formed by a planar wall through-out the section. However, as shown in FIGS. 11 and 12 which show the respective sections along the lines A'—A' and B'—B' both shown in FIG. 10, the longitudinal central portion 22 of the louver is inclined while each of the longitudinal end sides 21 of the louver is formed by a planar wall which is parallel with the direction in which the fluid passes. By virtue of this arrangement, the projection area of the longitudinal central portion 22 of each louver is made larger than each of the projection areas of the longitudinal end sides 21 of the louver.

Figure 13:
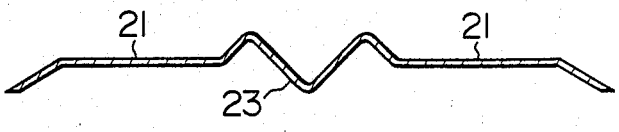
FIG. 13 is a view corresponding to FIG. 9 and showing a third embodiment of the present invention.

FIG. 13 shows a third embodiment of the invention. In this embodiment, the configuration of the longitudinal section through the longitudinal central portion 23 of each louver is zigzag shaped, thus substantially increasing the sectional area of the longitudinal central portion of the louver, and thereby increasing the projection area of this portion. The longitudinal end sides 21 of the louver is each formed by a planar wall.

With the embodiments shown in FIGS. 10 to 13, functions and effects that are substantially the same as those obtained in the embodiment shown in FIG. 9 are achieved, thereby enabling a remarkable increase in the standard of heat transfer performance without any increase in the air-passing resistance of the overall fin.

According to the present invention, since the air-passing resistance of the louver is varied so as to increase the overall heat exchange quantity, the heat transfer performance of the fin can be greatly enhanced.

What is claimed is:

1. A heat transfer tube comprising: a base plate mounted on a heat exchanger through fin collars; and louvers formed on said base plate, each louver being cut and raised from a surface of said base plate and having a length extending in a direction that crosses a direction of the flow of a fluid across said surface of said base plate, each louver having longitudinal end portions and a longitudinal central portion disposed therebetween; each louver being shaped such that an area of the louver in the vicinity of the longitudinal central portion thereof projected in the direction of the flow of said fluid is larger than an area of the louver in the vicinity of each of said longitudinal end portions thereof projected in the direction of the flow of said fluid, wherein a section of each louver in a plane parallel to the direction of the flow of said fluid has an angled configuration, and the angle of the section of each louver in the vicinity of the longitudinal central portion thereof is larger than the angle of the section of the louver in each of said longitudinal end portions of said louver.

2. A heat transfer fin comprising: a base plate mounted on at least a pair of spaced tubes through fin collars; and a louver formed on said base plate between said heat exchanger tubes and having a length extending in a direction that crosses the direction of the flow of a fluid, said louver being cut and raised from a surface of said base plate and projecting in a direction that crosses the direction of the flow of said fluid, said louver having portions adjacent to said heat exchanger tubes and a longitudinal central portion disposed therebetween, a section of said louver taken in a plane parallel to the direction of the flow of said fluid having an angled configuration, the angle of the section of the louver in the vicinity of said longitudinal central portion being larger than the angle of the section of said louver in the vicinity of each of said heat exchanger tubes.

* * * * *